US011993439B2

(12) United States Patent
Ball

(10) Patent No.: US 11,993,439 B2
(45) Date of Patent: May 28, 2024

(54) CARTON AND BLANK THEREFOR

(71) Applicant: WestRock Packaging Systems, LLC, Atlanta, GA (US)

(72) Inventor: Nathaniel B. Ball, Richmond, VA (US)

(73) Assignee: WestRock Packaging Systems, LLC, Atlanta, GA (US)

( * ) Notice: Subject to any disclaimer, the term of this patent is extended or adjusted under 35 U.S.C. 154(b) by 0 days.

(21) Appl. No.: 18/008,035

(22) PCT Filed: Jun. 3, 2021

(86) PCT No.: PCT/US2021/035660
§ 371 (c)(1),
(2) Date: Dec. 2, 2022

(87) PCT Pub. No.: WO2021/247835
PCT Pub. Date: Dec. 9, 2021

(65) Prior Publication Data

US 2023/0242316 A1 Aug. 3, 2023

Related U.S. Application Data

(60) Provisional application No. 63/034,019, filed on Jun. 3, 2020.

(51) Int. Cl.
*B65D 71/30* (2006.01)

(52) U.S. Cl.
CPC .... *B65D 71/30* (2013.01); *B65D 2571/00197* (2013.01); *B65D 2571/00271* (2013.01);
(Continued)

(58) Field of Classification Search
CPC ..... B65D 71/30; B65D 71/40; B65D 2571/00197; B65D 2571/00271;
(Continued)

(56) References Cited

U.S. PATENT DOCUMENTS 3,140,008 A * 7/1964 Spery ..... B65D 71/30 206/149
3,565,323 A 2/1971 Katzenmeyer
(Continued)

FOREIGN PATENT DOCUMENTS

FR 2088698 A5 1/1972
GB 2259686 A 3/1993

OTHER PUBLICATIONS

International Search Report issued in PCT/US2021/035660, dated Nov. 8, 2021.

*Primary Examiner* — Bryon P Gehman
(74) *Attorney, Agent, or Firm* — Brian J. Goldberg; Rohini K. Garg

(57) ABSTRACT

Aspects of the disclosure relate to a carton for packaging one or more article and a blank for forming the carton. The carton comprises a plurality of panels forming walls of a tubular structure including a top wall, a first side wall, a base wall, and a second side wall. The carton comprises a carrying handle having at least one handle panel hingedly connected at a proximal end thereof to one of the plurality of panels. The hinged connection is interrupted by at least one cut line defining a tab. The tab is struck from one of a portion of the one of the plurality of panels. The tab is integral with the at least one handle panel and extends from the hinged connection internally of the carton when in use.

18 Claims, 9 Drawing Sheets

(52) U.S. Cl.
CPC ..... *B65D 2571/00277* (2013.01); *B65D 2571/0029* (2013.01); *B65D 2571/00456* (2013.01); *B65D 2571/0066* (2013.01); *B65D 2571/00716* (2013.01); *B65D 2571/0087* (2013.01)

(58) Field of Classification Search
CPC .. B65D 2571/00277; B65D 2571/0029; B65D 2571/00456; B65D 2571/0066; B65D 2571/00716; B65D 2571/0087
USPC ..... 206/429, 434
See application file for complete search history.

(56) References Cited

U.S. PATENT DOCUMENTS

| | | | | |
|---|---|---|---|---|
| 3,780,906 | A | 12/1973 | Katzenmeyer | |
| 6,109,438 | A * | 8/2000 | Sutherland | B65D 71/16 206/427 |
| 6,155,412 | A * | 12/2000 | Le Bras | B65D 71/30 206/199 |
| 2003/0094386 | A1 * | 5/2003 | Auclair | B65D 71/14 206/141 |

* cited by examiner

CARTON AND BLANK THEREFOR

CROSS REFERENCE TO RELATED APPLICATIONS

This Application is a U.S. 371 National Phase Patent Application of International PCT Patent Application No. PCT/US2021/035660, filed Jun. 3, 2021, which claims priority to U.S. Provisional Patent Application No. 63/034,019, filed on Jun. 3, 2020. The entire contents of these applications are incorporated herein by reference.

TECHNICAL FIELD

The present invention relates to cartons or carriers and to blanks for forming the same. More specifically, but not exclusively, the invention relates to a carrier of the wrap-around type having a carrying handle structure.

BACKGROUND

In the field of packaging it is known to provide cartons for carrying multiple articles. Cartons are well known in the art and are useful for enabling consumers to transport, store and access a group of articles for consumption. For cost and environmental considerations, such cartons or carriers need to be formed from as little material as possible and cause as little wastage in the materials from which they are formed as possible. Further considerations are the strength of the carton and its suitability for holding and transporting large weights of articles. It is desirable that the contents of the carton are secure within the carton.

It is an object of the present disclosure to provide an article carrier having carrying handle structure. Another object of the present disclosure is to provide an article retention device for securing the article within the carton.

The present invention seeks to provide an improvement in the field of cartons, typically formed from paperboard or the like.

SUMMARY

An aspect of the invention provides a carton for packaging one or more articles. The carton comprises a plurality of panels forming walls of a tubular structure including a top wall, a first side wall, a base wall, and a second side wall. The carton comprises a carrying handle having at least one handle panel hingedly connected at a proximal end thereof to one of the plurality of panels. The hinged connection is interrupted by at least one cut line defining a tab. The tab is struck from one of said one of the plurality of panels. The tab may be struck from one of an upper or lower portion of the first side wall panel. The tab is integral with the at least one handle panel and extends from the hinged connection internally of the carton when in use.

Optionally, the at least one handle panel comprises a handle opening. The handle opening is spaced a first distance from the hinged connection. The handle opening is spaced a maximum distance equal to the sum of the first distance and a second distance from a proximal end of the at least one handle panel. The second distance is a maximum linear dimension of the tab measured from the hinged connection to a distal end of the tab.

Optionally, the at least one handle panel comprises a first handle panel and a second handle panel each comprising a handle opening. The first handle panel and a second handle panel are hingedly connected to each other at distal ends thereof. The first handle panel is hingedly connected to a lower first side wall panel portion by a first proximal hinged connection and the second handle panel is hingedly connected to an upper first side wall panel portion by a second proximal hinged connection. Each of the handle openings is spaced a first distance from the respective one of the first and second proximal hinged connections. Each of the first and second proximal hinged connections is interrupted by at least one cut line so as to define a tab. The handle openings are spaced a maximum distance equal to the sum of the first distance and a second distance from a proximal end of the respective one first and second handle panels. The second distance is a maximum linear dimension of the respective tab measured from the hinged connection to a distal end of said respective tab Optionally, the carrying handle is hingedly connected to the first side wall.

Optionally, the carrying handle comprises first and second handle panels hingedly connected to each other at a distal end thereof and hingedly connected to a respective one of an upper and a lower first side wall panel portion at proximal ends thereof.

Another aspect of the invention provides a carton for packaging one or more articles. The carton comprises a plurality of panels forming walls of a tubular structure including a top wall, a first side wall, a base wall, and a second side wall. The carton comprises a carrying handle having at least one handle panel hingedly connected to one of the first side wall or second side wall. The carrying handle comprises at least one handle panel hingedly connected at a proximal end to said one of the first side wall or second side wall by at least one fold line. The at least one fold line is disposed in a spaced apart relationship from each of the top wall and the base wall. The at least one fold line is oriented substantially parallel to the top wall and to the base wall.

Optionally, the at least one fold line is oriented substantially parallel to the hinged connection between said one of the first side wall or second side wall and the top wall.

Optionally, the at least one fold line is oriented substantially parallel to the hinged connection between said one of the first side wall or second side wall and the base wall.

Optionally, said one of the first side wall or second side wall comprises an upper corner panel.

Optionally, said one of the first side wall or second side wall comprises a shoulder panel.

Optionally, said one of the first side wall or second side wall comprises a lower corner panel.

Optionally, said one of the first side wall or second side wall comprises a heel panel.

Optionally, the at least one handle panel is detachably secured in face contacting relationship to said one of the first side wall or second side wall.

Optionally, the at least one handle panel is folded into in face contacting relationship to said one of the first side wall or second side wall.

Optionally, the at least one handle panel is adhesively secured by a bond in face contacting relationship to said one of the first side wall or second side wall, said bond being severable such that the at least one handle panel is foldable outwardly of the tubular structure.

Yet another aspect of the invention provides a carton for packaging one or more articles. The carton comprises a plurality of panels forming walls of a tubular structure including a top wall, a first side wall, a base wall, and a second side wall. The carton comprises a carrying handle having at least one handle panel hingedly connected to one of the first side wall or second side wall. The carrying handle comprises at least one handle panel hingedly connected at a proximal end to said one of the first side wall or second side wall by at least one fold line. A hinged proximal end of the at least one handle panel is disposed in a spaced apart relationship from each of the top wall and the base wall. The hinged proximal end of the at least one handle panel is oriented substantially parallel to the top wall and to the base wall.

A further aspect of the invention provides a carton for packaging one or more articles. The carton comprises a plurality of panels forming walls of a tubular structure including a base wall, a first side wall, and a first heel panel hingedly connected therebetween. The carton comprises opening forming an article engaging device. The opening is struck at least in part from the first heel panel. The opening comprises an upper portion and a lower portion. The lower portion is narrower in width than the upper portion. The lower portion defines opposing free edges of the first heel panel. The free edges are configured to form a close fit with a lobe of a petaloid base of an article being packaged, the opposing free edges inhibit movement of the article when the petaloid lobe of the article is received in the opening.

Optionally, the opening is struck in part from the base wall.

Optionally, the opening is struck in part from the first side wall.

Optionally, the lower portion defines tapered opposing free edges of the first heel panel, the tapered opposing free edges converge towards the base wall.

Optionally, the lower portion of the opening extends into the base wall and defines a free edge which engages a base of the article.

Optionally, the carton comprises a top panel having an article receiving aperture for receiving an upper end of the article.

Yet a further aspect of the invention provides a blank for forming a carton. The blank comprises a plurality of panels forming walls of a tubular structure including a top wall, a first side wall, a base wall, and a second side wall. The blank comprises a carrying handle having at least one handle panel hingedly connected at a proximal end thereof to one of the plurality of panels. The hinged connection is interrupted by at least one cut line defining a tab. The tab is struck from a portion of the one of the plurality of panels. The tab may be struck from one of an upper or lower portion of the first side wall panel. The tab is integral with the at least one handle panel and extends from the hinged connection internally of the carton when in use Still yet a further aspect of the invention provides blank for forming a carton. The blank comprises a plurality of panels forming walls of a tubular structure including; a top wall, a first side wall, a base wall, and a second side wall. The blank comprises a carrying handle having at least one handle panel hingedly connected to one of the first side wall or second side wall. The carrying handle comprises at least one handle panel hingedly connected at a proximal end to said one of the first side wall or second side wall by at least one fold line. The at least one fold line is disposed in a spaced apart relationship from each of the top wall and the base wall. The at least one fold line is oriented substantially parallel to the top wall and to the base wall.

Still yet another aspect of the invention provides a blank for forming a carton. The blank comprises a plurality of panels forming walls of a tubular structure including a top wall, a first side wall, a base wall, and a second side wall. The blank comprises a carrying handle having at least one handle panel hingedly connected to one of the first side wall or second side wall. The carrying handle comprises at least one handle panel hingedly connected at a proximal end to said one of the first side wall or second side wall by at least one fold line. A hinged proximal end of the at least one handle panel is disposed in a spaced apart relationship from each of the top wall and the base wall. The hinged proximal end of the at least one handle panel is oriented substantially parallel to the top wall and to the base wall.

A further aspect of the invention provides a blank for forming a carton. The blank comprises a plurality of panels forming walls of a tubular structure including a base wall, a first side wall, and a first heel panel hingedly connected therebetween. The blank comprises opening forming an article engaging device. The opening is struck at least in part from the first heel panel. The opening comprises an upper portion and a lower portion. The lower portion is narrower in width than the upper portion. The lower portion defines opposing free edges of the first heel panel. The free edges are configured to form a close fit with a lobe of a petaloid base of an article being packaged. The opposing free edges inhibit movement of the article when the petaloid lobe of the article is received in the opening.

A further aspect of the invention provides a package which includes a carton and a plurality of articles each having a generally cylindrical body. The carton comprises a plurality of panels forming walls of a tubular structure which defines an interior of the carton. The plurality of articles is received at least partially in the interior of the carton. The walls of the tubular structure include a top wall, a first side wall, a base wall, and a second side wall. The carton comprises a carrying handle having at least one handle panel hingedly connected at its proximal end to one of the first and second side walls. The hinged connection is interrupted by at least one cut line defining a tab. The tab is struck from a portion of the one of the first and second side walls and is integral with the at least one handle panel. When the handle is in use, the tab extends into the interior of the carton and is disposed between the generally cylindrical bodies of adjacent articles.

Within the scope of this application it is envisaged or intended that the various aspects, embodiments, examples, features and alternatives set out in the preceding paragraphs, in the claims and/or in the following description and drawings may be considered or taken independently or in any combination thereof.

Features or elements described in connection with, or relation to, one embodiment are applicable to all embodiments unless there is an incompatibility of features. One or more features or elements from one embodiment may be incorporated into, or combined with, any of the other embodiments disclosed herein, said features or elements extracted from said one embodiment may be included in addition to, or in replacement of one or more features or elements of said other embodiment.

A feature, or combination of features, of an embodiment disclosed herein may be extracted in isolation from other features of that embodiment. Alternatively, a feature, or combination of features, of an embodiment may be omitted from that embodiment.

BRIEF DESCRIPTION OF THE DRAWINGS

Embodiments of the invention will now be described with reference to the accompanying drawings, in which.

DETAILED DESCRIPTION OF EMBODIMENTS

Detailed descriptions of specific embodiments of the package, blanks and cartons are disclosed herein. It will be understood that the disclosed embodiments are merely examples of the way in which certain aspects of the invention can be implemented and do not represent an exhaustive list of all of the ways the invention may be embodied. As used herein, the word "exemplary" is used expansively to refer to embodiments that serve as illustrations, specimens, models, or patterns. Indeed, it will be understood that the packages, blanks and cartons described herein may be embodied in various and alternative forms. The Figures are not necessarily to scale and some features may be exaggerated or minimised to show details of particular components. Well-known components, materials or methods are not necessarily described in great detail in order to avoid obscuring the present disclosure. Any specific structural and functional details disclosed herein are not to be interpreted as limiting, but merely as a basis for the claims and as a representative basis for teaching one skilled in the art to variously employ the invention.

Figure 1:
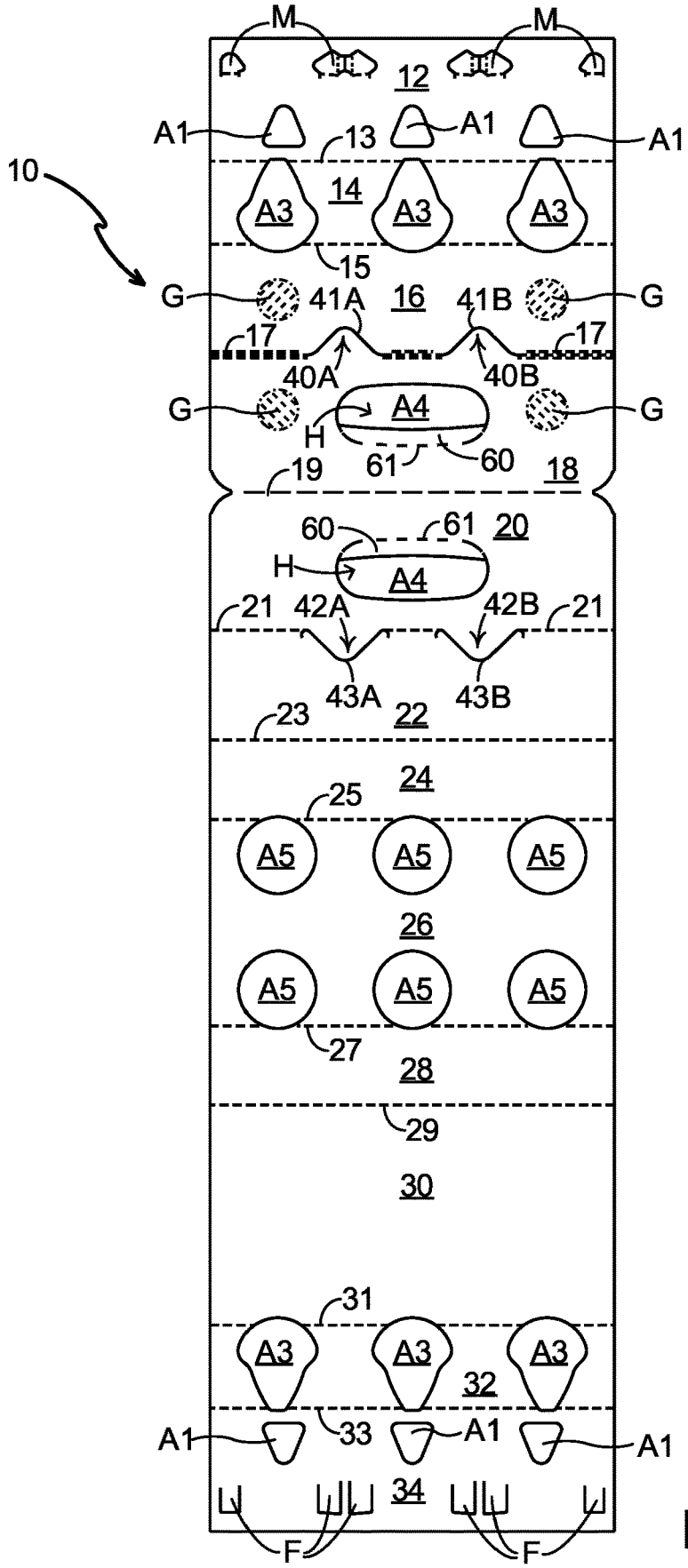
FIG. 1 is a plan view from above of a blank for forming a carton according to a first embodiment.
Figure 2:
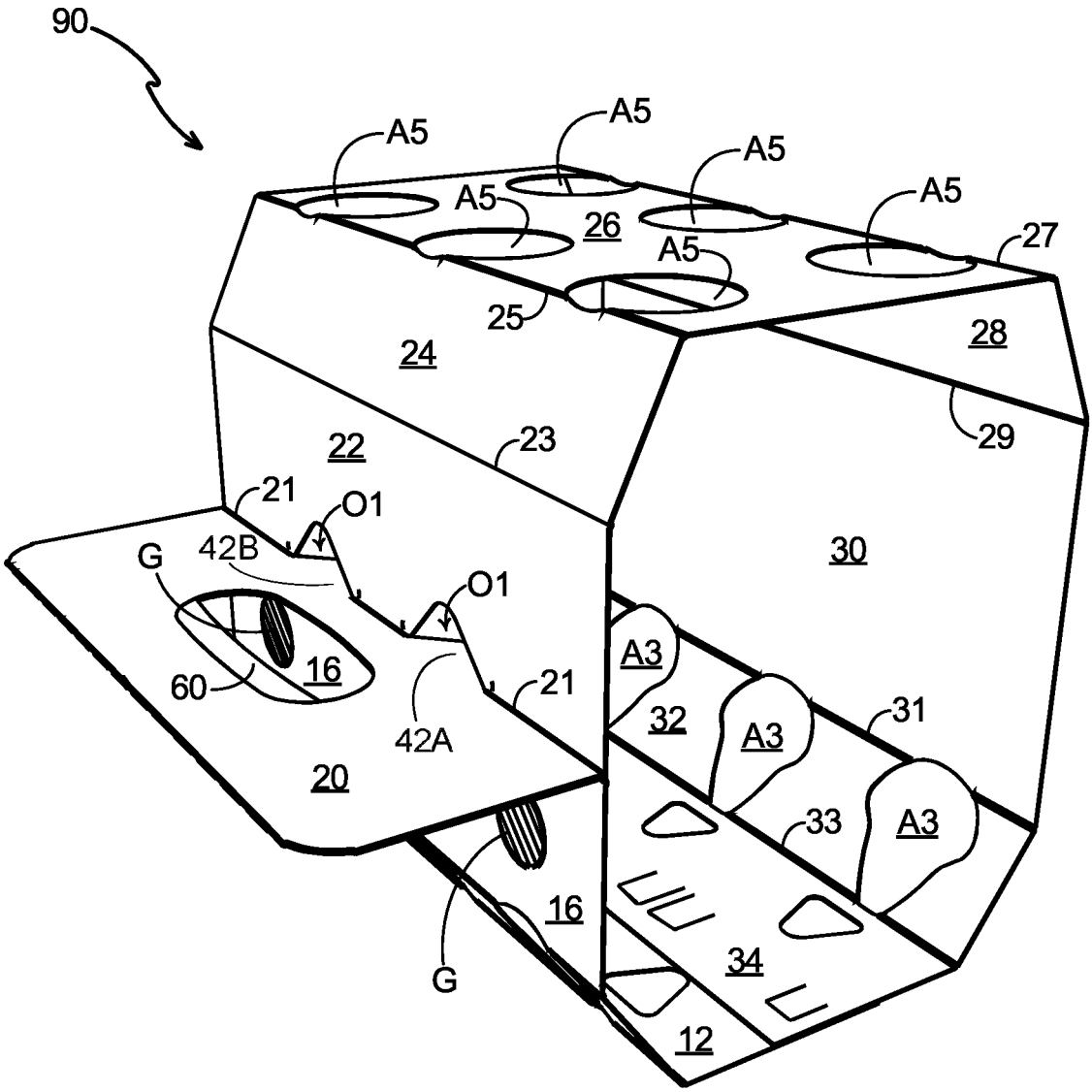
FIG. 2 is a perspective view from above of a carton formed from the blank of FIG. 1.
Figure 3:
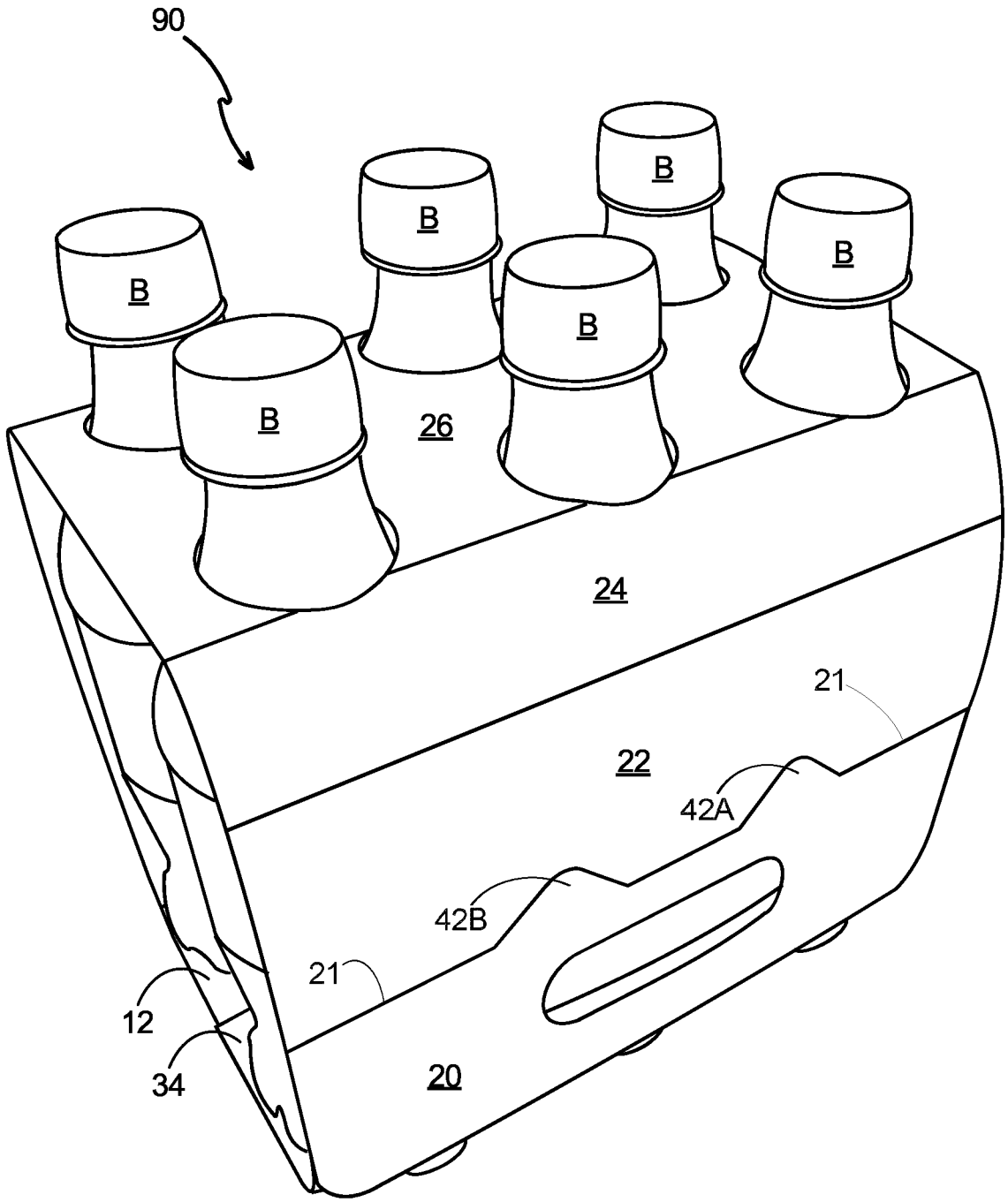
FIG. 3 is a perspective view from above of a package formed from the carton of FIG. 2 and a group of articles.

Referring to FIG. 1, there is shown a plan view of a blank 10 capable of forming a carton or carrier 90, as shown in FIG. 2, for containing and carrying a group of primary products such as, but not limited to, bottles or cans, hereinafter referred to as articles B, as shown in FIG. 3. The blank 10 forms a secondary package for packaging at least one primary product container or package.

In the embodiments detailed herein, the terms "carton" and "carrier" refer, for the non-limiting purpose of illustrating the various features of the invention, to a container 90 for engaging and carrying articles B, such as primary product containers B. It is contemplated that the teachings of the invention can be applied to various product containers B, which may or may not be tapered and/or cylindrical. Exemplary containers include bottles B (for example metallic, glass or plastics bottles), cans (for example aluminium cans), tins, pouches, packets and the like.

The blank 10 is formed from a sheet of suitable substrate. It is to be understood that, as used herein, the term "suitable substrate" includes all manner of foldable sheet material such as paperboard, corrugated board, cardboard, plastic, combinations thereof, and the like. It should be recognised that one or other numbers of blanks may be employed, where suitable, for example, to provide the carrier structure described in more detail below.

The packaging structures or cartons described herein may be formed from a sheet material such as paperboard, which may be made of or coated with materials to increase its strength. An example of such a sheet material is tear-resistant NATRALOCK® paperboard made by WestRock Company. It should be noted that the tear resistant materials may be provided by more than one layer, to help improve the tear-resistance of the package. Typically, one surface of the sheet material may have different characteristics to the other surface. For example, the surface of the sheet material that faces outwardly from a finished package may be particularly smooth and may have a coating such as a clay coating or other surface treatment to provide good printability. The surface of the sheet material that faces inwardly may, on the other hand, be provided with a coating, a layer, a treatment or be otherwise prepared to provide properties such as one or more of tear-resistance, good glue-ability, heat sealability, or other desired functional properties.

In the embodiment illustrated in FIG. 1, the blank 10 is configured to form a carton or carrier 90 for packaging an exemplary arrangement of exemplary articles B. In the embodiment illustrated, the arrangement is a 3×2 matrix or array; in the illustrated embodiment two rows of three articles B are provided, and the articles B are 500 ml plastic bottles each having a generally cylindrical body and a petaloid base structure.

Alternatively, the blank 10 can be configured to form a carrier for packaging other types, number and size of articles B and/or for packaging articles B in a different arrangement or configuration.

The present invention relates generally to a carton 90 for packaging articles B which carton 90 comprises a carrying handle H.

Embodiments described herein may comprise an article engaging arrangement for engaging an article B.

Turning to FIG. 1, there is illustrated a blank 10 for forming a carton 90 according to a first embodiment. The blank 10 comprises a plurality of main panels 12, 14, 16, 18, 20, 22, 24, 26, 28, 30, 32, 34 for forming a tubular structure. The plurality of main panels 12, 14, 16, 18, 20, 22, 24, 26, 28, 30, 32, 34 comprises; a first base panel 12, a first corner panel 14 (also referred to herein as a heel panel), a first or lower first side panel portion 16, a first handle panel 18, a second handle panel 20, a second or upper first side panel portion 22, a second corner panel 24 (also referred to herein as a shoulder panel), a top panel 26, a third corner panel 28 (also referred to herein as a shoulder panel), a second side panel 30, a fourth corner panel 32 (also referred to herein as a heel panel), and a second base panel 34. The plurality of panels 12, 14, 16, 18, 20, 22, 24, 26, 28, 30, 32, 34 may be arranged in a linear series hinged one to the next by corresponding fold lines 13, 15, 17, 19, 21, 23, 25, 27, 29, 31, 33.

The first base panel 12 is hinged to the first corner panel 14 by a hinged connection in the form of a fold line 13. The first corner panel 14 is hinged to the first first side panel portion 16 by a hinged connection in the form of a fold line 15. The first first side panel portion 16 is hinged to the first handle panel 18 by a hinged connection in the form of a fold line 17. The first handle panel 18 is hinged to the second handle panel 20 by a hinged connection in the form of a fold line 19. The second handle panel 20 is hinged to the second first side panel portion 22 by a hinged connection in the form of a fold line 21. The second first side panel portion 22 is hinged to the second corner panel 24 by a hinged connection in the form of a fold line 23. The second corner panel 24 is hinged to the top panel 26 by a hinged connection in the form of a fold line 25. The top panel 26 is hinged to the third corner panel 28 by a hinged connection in the form of a fold line 27. The third corner panel 28 is hinged to the second side panel 30 by a hinged connection in the form of a fold line 29. The second side panel 30 is hinged to the fourth corner panel 32 by a hinged connection in the form of a fold line 31. The fourth corner panel 32 is hinged to the second base panel 34 by a hinged connection in the form of a fold line 33.

The first corner panel 14 and the fourth corner panel 32 may be considered to form part of a side wall of the carton 90 or alternatively part of a base wall of the carton 90. The second corner panel 22 and the third corner panel 28 may be considered to form part of a side wall of the carton 90 or alternatively part of a top wall of the carton 90.

The blank 10 is foldable to form a package 90 as illustrated in FIGS. 2 and 3. The first and second base panels 12, 34 are engageable with one another in an overlapping relationship to form a composite base wall 12/34 of the carton 90. The blank 10 may comprise a complementary locking mechanism for securing the second base panel 34 to the first base panel 12.

The second base panel 34 may comprise at least one first part F of the complementary locking mechanism. The first base panel 12 may comprise at least one second part M of the complementary locking mechanism. In the illustrated embodiment, the first base panel 12 comprises a plurality of male tabs M. The second base panel 34 comprises a plurality of female tabs F defining openings in the second base panel 34, the openings in the second base panel 34 being configured to receive a respective one of the male tabs M. The female tabs F are arranged to be displaced out of the second base panel 34 to form the openings and to bear against the male tabs M when received therein. The openings form a receiver for receiving the male tabs M. In some embodiments the female tabs F may be omitted.

The first and second base panels 12, 34 may comprise at least one first aperture A1. In the illustrated embodiment, the first base panel 12 comprises three first apertures A1, the second base panel 34 comprises three first apertures A1. The first apertures A1 may be employed to facilitate construction of the carton 90. A packaging machine component may engage with the first apertures A1 to enable the plurality of panels 12, 14, 16, 18, 20, 22, 24, 26, 28, 30, 32, 34 to be tightened about a group of articles B. The first apertures A1 may also be employed to facilitate alignment of the first and second base panels 12, 34 with respect to each other or to align the first part of the complementary locking mechanism with the second part of the complementary locking mechanism.

The complementary locking mechanism illustrated and described is entirely optional.

The blank 10 comprises a carrying handle structure. The carrying handle structure is provided by the first handle panel 18 and the second handle panel 20. The first handle panel 20 comprises a handle opening H defined at least in part by a handle aperture A4. The handle opening H may be defined at least in part by a flap 60 which serves as a cushioning flap when the carrying handle is in use. The flap 60 is hinged to the first handle panel 18 by a hinged connection in the form of a fold line 61.

The second handle panel 20 comprises a handle opening H defined at least in part by a handle aperture A4. The handle opening H may be defined at least in part by a flap 60 which serves as a cushioning flap when the carrying handle is in use. The flap 60 is hinged to the first handle panel 18 by a hinged connection in the form of a fold line 61.

The handle opening H in the second handle panel 20 is configured to be in registry with the handle opening H in the first handle panel 18, when the first and second handle panels 18, 20 are folded to be disposed in face to face relationship with each other.

The first and second handle panels 18, 20 are arranged to provide a carrying handle hingedly connected to the first side wall of the carton 90. The carrying handle can be folded or manipulated between a first stowed condition as shown in FIG. 3 and second deployed or operable condition as shown in FIGS. 2, 5, 6, and 7.

The hinged connection between the first handle panel 18 and the first first side panel portion 16 is interrupted by a first cutline 41A. The first cutline 41A defines, at least in part a first tab 40A.

The hinged connection between the first handle panel 18 and the first first side panel portion 16 is interrupted by a second cutline 41B. The second cutline 41B defines, at least in part a second tab 40B.

The hinged connection between the second handle panel 20 and the second first side panel portion 22 is interrupted by a third cutline 43A. The third cutline 43A defines, at least in part a third tab 42A.

The hinged connection between the second handle panel 20 and the second first side panel portion 22 is interrupted by a fourth cutline 43B. The fourth cutline 43B defines, at least in part a fourth tab 42B.

The first tab 40A is arranged to be in registry with the third tab 42A. The second tab 40B is arranged to be in registry with the fourth tab 42B. The tabs 40A, 40B, 42A, 42B provide glue regions facilitating securing the first and second handle panels 18, 20 together.

The first and third tabs 40A, 42A form a first projection, extending from the handle panels 18, 20. The second and fourth tabs 40B, 42B form a second projection, extending from the handle panels 18, 20. The projections are arranged so as to be aligned with a gap or void between a pair of adjacently disposed articles B. In the illustrated embodiment the articles B are generally cylindrical in shape and a void is provided between the said articles B and the first side wall 16/22 even when the adjacently disposed articles B are in contact with each other.

It is desirable to secure a region of the first handle panel 18 between the handle opening H and the first first side panel portion 16 to a region of the second handle panel 20 between the handle opening H and the second first side panel portion 22.

The provision of the tabs 40A, 40B allows provision of sufficient material for securing the handle panels 18, 20 and provides that the handle opening H in the first handle panel 18 can be disposed in closer proximity to the first first side panel portion 16 and/or fold line 17 than would be otherwise possible in the absence of the tabs 40A, 40B.

The provision of the tabs 42A, 42B allows provision of sufficient material for securing the handle panels 18, 20 and provides that the handle opening H in the second handle panel 20 can be disposed in closer proximity to the second first side panel portion 22 and/or fold line 21 than would be otherwise possible in the absence of the tabs 42A, 42B.

The handle opening H in the second handle panel 20 is spaced apart from the fold line 21 by a first distance d1. The tabs 42A, 42A extend from the fold line 17 into a region which would otherwise form part of the second first side panel portion 22 by a second distance d2. In this way the edge of the second handle panel 20 is spaced d1+d2 from the handle opening H.

The hinged connection between first handle panel 18 and the first first side panel portion 16 may comprise a plurality of predefined parallel folds, scores or embossments.

The carrying handle comprises at least one handle panel 18, 20, (the illustrated embodiment comprises two handle panels 18, 20) hingedly connected at a proximal end to the first side wall 16/22 of the carton 90 by at least one handle fold line 17, 21 (the illustrated embodiment comprises two fold lines 17, 21 which are in registry with each other). The proximal end of the carrying handle is spaced apart from both the top wall 26 and base wall 12/34 and is substantially parallel to the top wall 26 and/or base wall 12/34 of the carton 90.

The first first side panel portion 16 and the first handle panel 18 comprise securing regions G, glue or other adhesive treatment may be applied to the securing regions G of first first side panel portion 16 and/or the first handle panel 18. A fugitive glue or hot melt glue may be applied in some embodiments. In other embodiments glue or other adhesive treatment may be applied to second first side panel portion 22 and/or the second handle panel 20, in such embodiment the carrying handle is folded upwardly when in the stowed condition whereas in the illustrated embodiment the carrying handle is folded downwardly when in the stowed condition as shown in FIG. 3.

Optionally, the top panel 26 comprises a plurality of article receiving apertures A5. In a set up condition each article receiving apertures A5 receives a portion of an article B.

The first corner panel 12 comprises at least one article engaging aperture A3. In the illustrated embodiment, the first corner panel 12 comprises three article engaging apertures A3.

The fourth corner panel 32 comprises at least one article engaging aperture A3. In the illustrated embodiment, the fourth corner panel 32 comprises three article engaging apertures A3.

Figure 4:
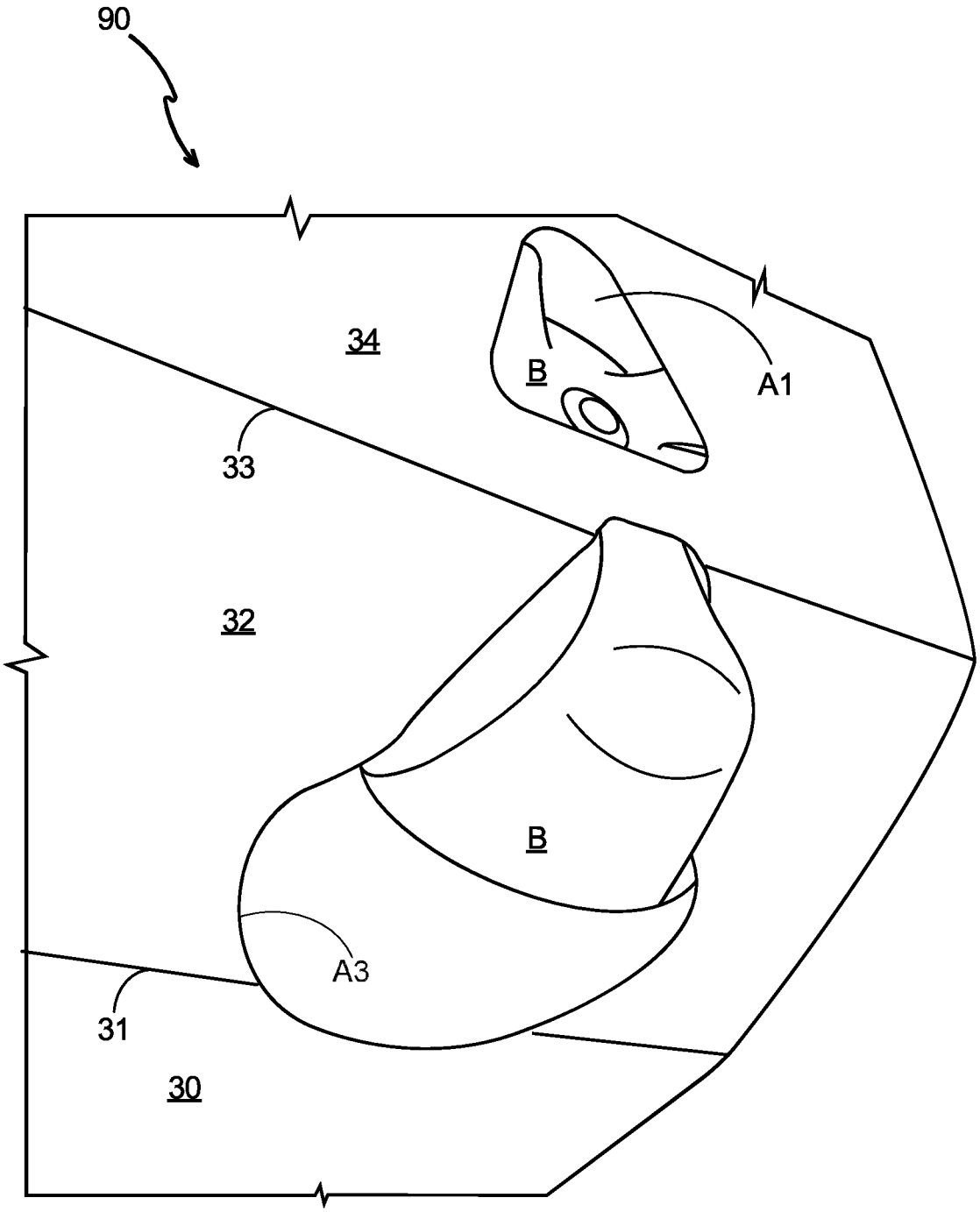
FIG. 4 is a perspective view from below of a portion of the carton of FIG. 2.

The article engaging apertures A3 comprise a wider upper portion and a narrower lower portion. The lower portion is tapered such that the article engaging apertures A3 reduce in with as they approach the first or second base panel 12, 34. The article engaging apertures A3 are generally cone-shaped so as to be engageable with an article B having a petaloid base structure. The article engaging apertures A3 allow one of the lobes of the petaloid base to pass through the corner panel 12, 32 and forms close fit so as to stabilise the article B and retain the article B in the carton 90, best shown in FIG. 4. The tapered or narrow portion of article engaging apertures A3 engages with opposed side of the lobe so as to prevent, restrict or inhibit movement of the article B, in particular in a longitudinal direction extending along the tubular axis of the carton 90.

Figure 1B:
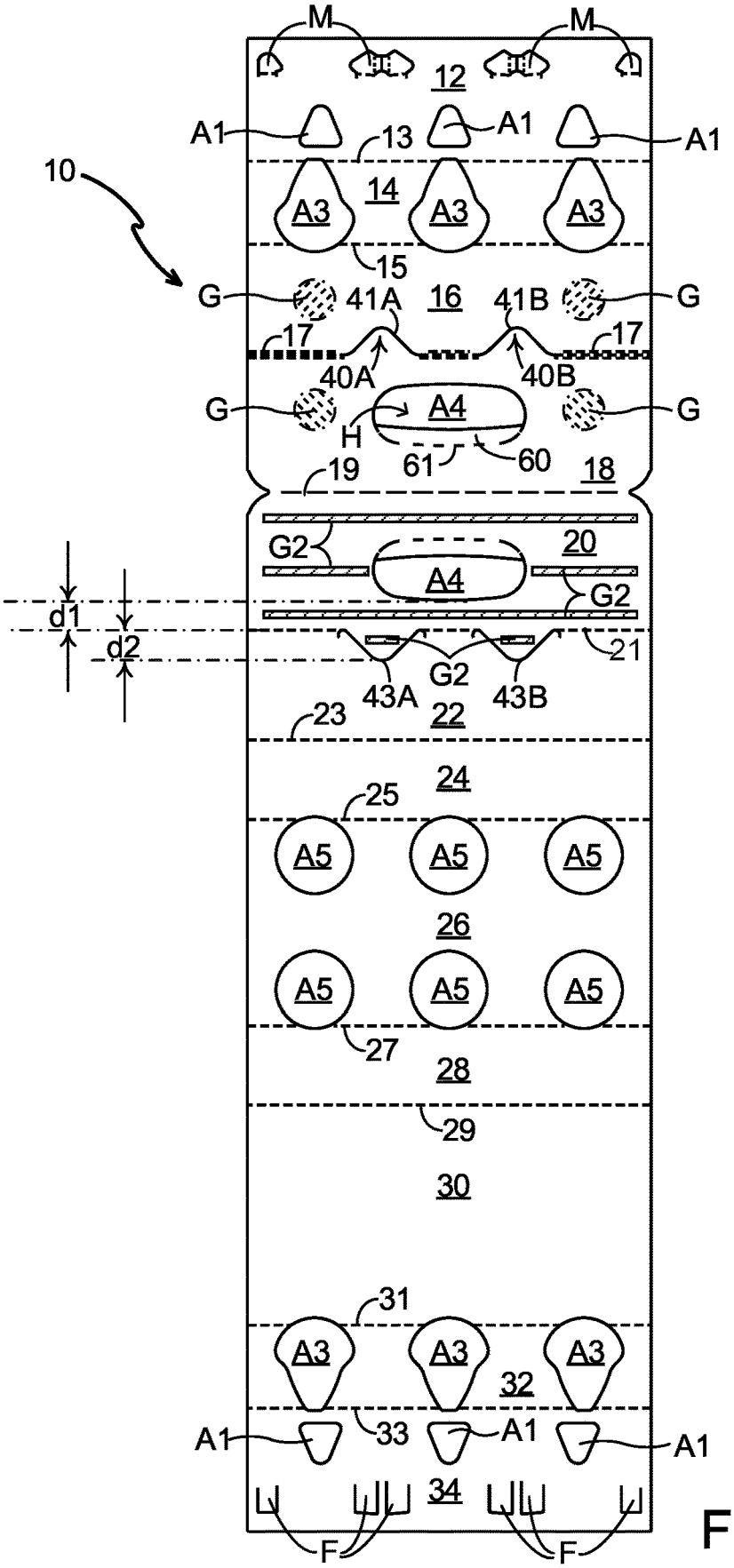
FIGS. 1B and 1C illustrate stages of construction of the blank of FIG. 1.

Turning to the construction of the carton 90, the carton 90 can be formed by a series of sequential folding operations in a straight-line machine so that the carton 90 is not required to be rotated or inverted to complete its construction. The folding process is not limited to that described below and may be altered according to particular manufacturing requirements. Glue G2 or other adhesive treatment is applied to the second handle panel 20, glue G2 is applied to the third and fourth tabs 42A, 42B, as shown in FIG. 1B. In other embodiments the glue may be applied to the first handle panel 18, glue may be applied to the first and second tabs 40A, 40B.

Referring to FIGS. 1 and 1B, the first and second handle panels 18, 20 are secured together in a flat face contacting arrangement by means of the glue strips G2. The first handle panel 18 is hingedly connected at its proximal end to the panel 16 along the first hinged connection 17. The first handle panel 18 extends from the first hinged connection 17 to a distal end 19 of the first handle panel 18. The first hinged connection 17 is interrupted by cut lines 41A, 41B which define first tabs 40A, 40B. The first tabs 40A, 40B are formed from a portion of the panel 16 and are integral with the first handle panel 18. The first tabs 40A, 40B each extends from the first hinged connection 17 away from the distal end 19. The second handle panel 20 is hingedly connected at its proximal end to the panel 22 along a second hinged connection 21 and extends to a distal end 19 of the second handle panel 20. The distal end 19 is a common distal end of the first and second handle panels 18, 20. The second hinged connection 21 is interrupted by cut lines 43A, 43B which define second tabs 42A, 42B. The second tabs 42A, 42B each is struck from a portion of the panel 22. The second tabs 42A, 42B are integral with the second handle panel 20 and extend from the second hinged connection 21 away from the distal end 19. When the first and second handle panels 18, 20 are secured together, the first and second hinged connections 17, 21 are coextensive to serve as a single hinge line about which the carrying handle is foldable. The first tabs 40A, 40B are secured to the second tabs 42A, 42B respectively in face-contacting arrangement such that the first and second handle panels 18, 20 are secured along both the regions disposed on opposite sides of the single hinge 17, 21.

Figure 1C:
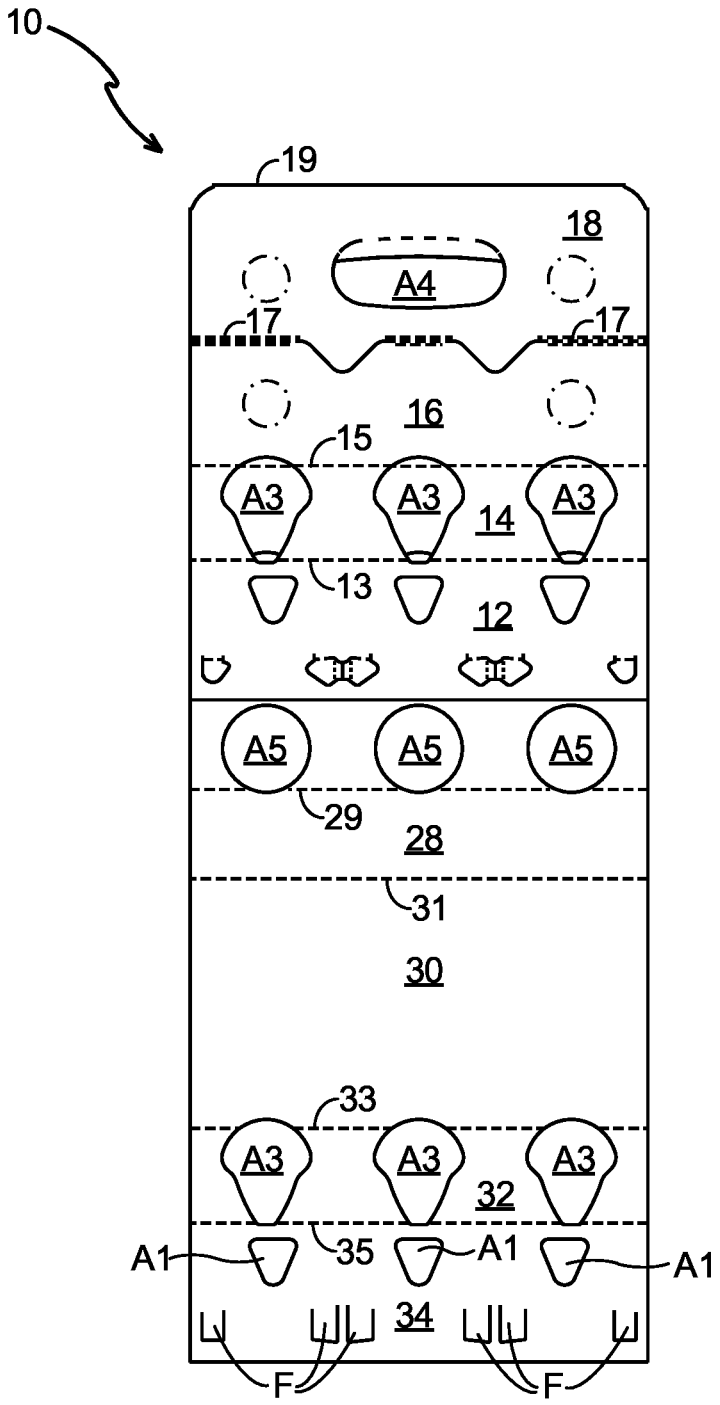

The blank 10 is folded about fold line 19 to bring the first handle panel 20 into face contacting relationship with the second handle panel 20, as shown in FIG. 1C. The first first side panel portion 16 is brought into face to face relationship with the second first side panel portion 22. The first corner panel 14 is brought into face to face relationship with the second corner panel 24. The first base panel 12 is brought into face to face relationship with the top panel 26.

In this way a part formed blank 10 is created, the part formed blank 10 can be shipped or distributed to a convertor plant, at which the part formed blank 10 may be erected into an article carrier about a group of articles B.

A group of articles B is assembled; in the preferred embodiment six articles B are arranged in a 3×2 array. The top panel 26 of the blank 10 is disposed above the group of articles B to provide a top wall 26 of the carton 90.

The second and third corner panels 24, 28 are folded about the opposing sides of upper portions or shoulders of the articles B in the group of articles B.

The first sidewalls 16/22 and the second side wall 24/26 are folded about the opposing sides of the group of articles B.

The first and fourth corner panels 14, 32 are folded about the opposing sides of lower portions or heels of the articles B in the group of articles B.

The second base panel 34 is folded about the fold line 33 so as to be disposed adjacent the base of the group of articles B. The first base panel 12 is then folded about the fold line 13 so as to be in at least partial overlapping relationship with the second base panel 34. The first and second base panels 12, 34 are secured together. Each of the male tabs M is displaced inwardly out of the plane of the first base panel 12. In so doing, each of the female tabs F is displaced inwardly creating a corresponding opening in the second base panel 34. The male tabs M are received in respective ones of the openings so as to lock the first and second base panels 12, 34 together. In this way a tubular structure is formed about the group of articles B.

The first and second handle panels 18, 20 are folded such that the first handle panel 18 faces outwardly, glue is applied to the first handle panel 18 or the first first side panel portion 16.

The first and second handle panels 18, 20 are folded downwardly such that the first handle panel 18 faces inwardly and is brought into face contacting relationship with the first first side panel portion 16.

The first handle panel 18 is secured to the first first side panel portion 16.

Figure 5:
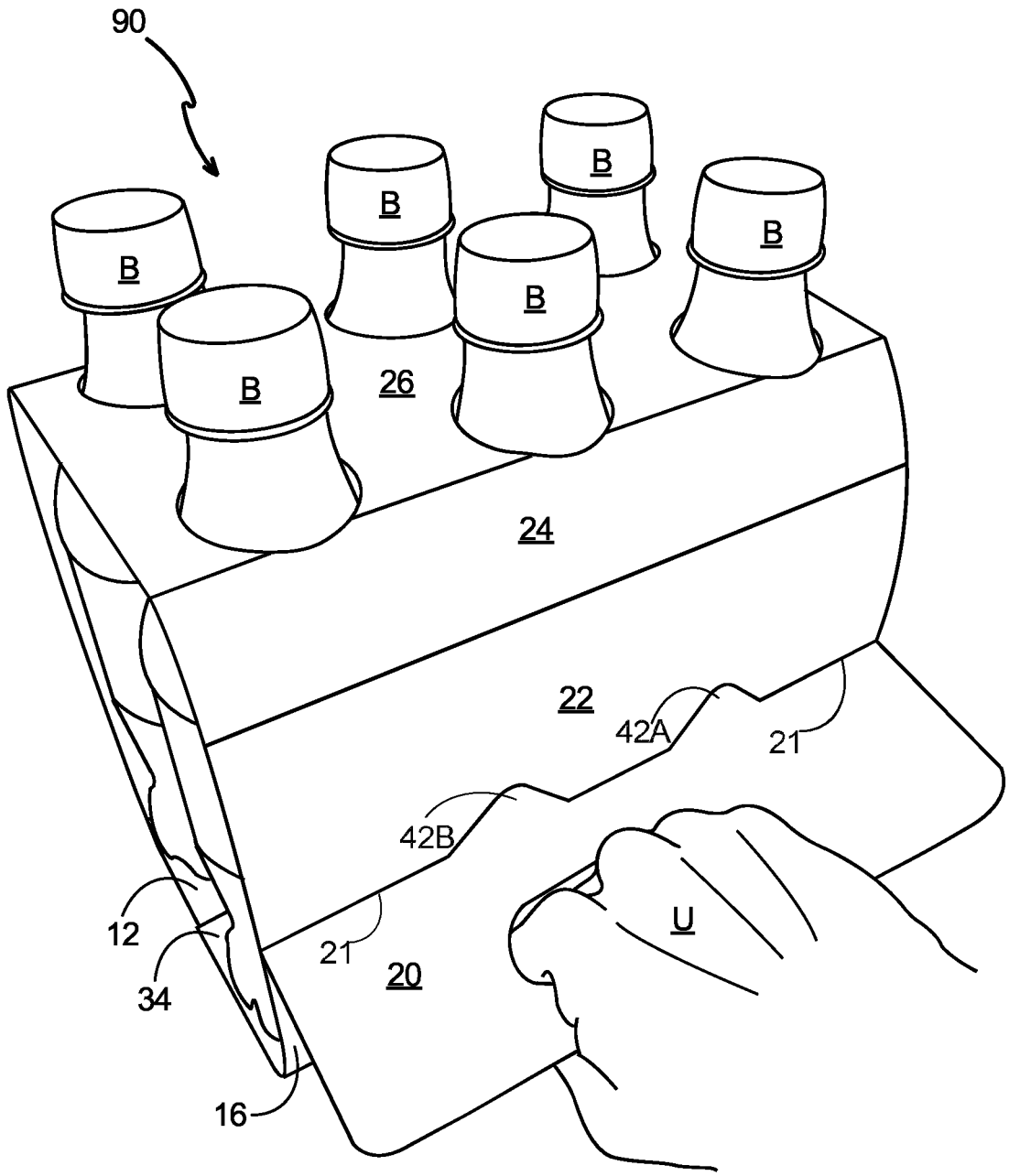
FIGS. 5, 6, and 7 are perspective views of the carton of FIG. 2 showing a carrying handle in use.
Figure 6:
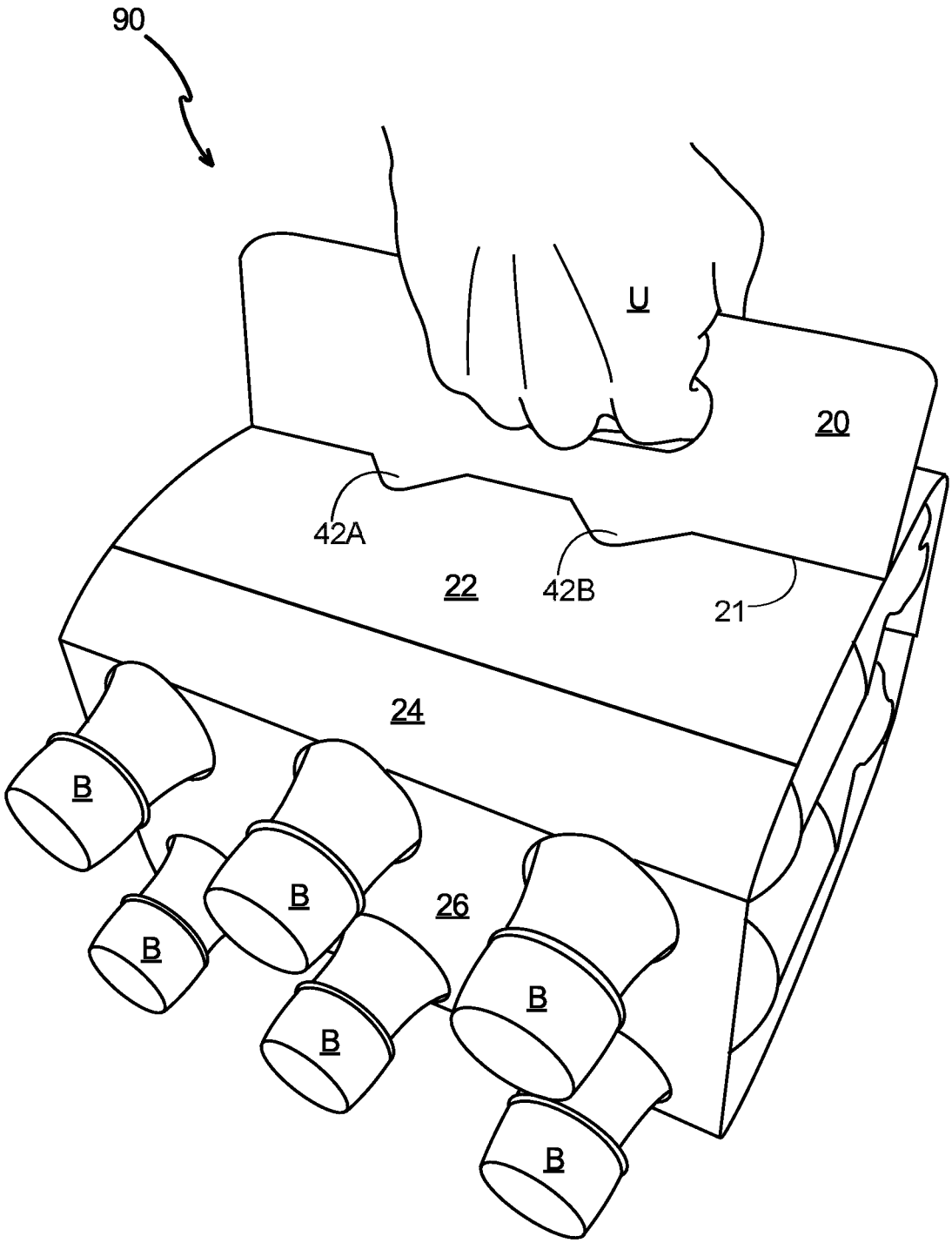
Figure 7:
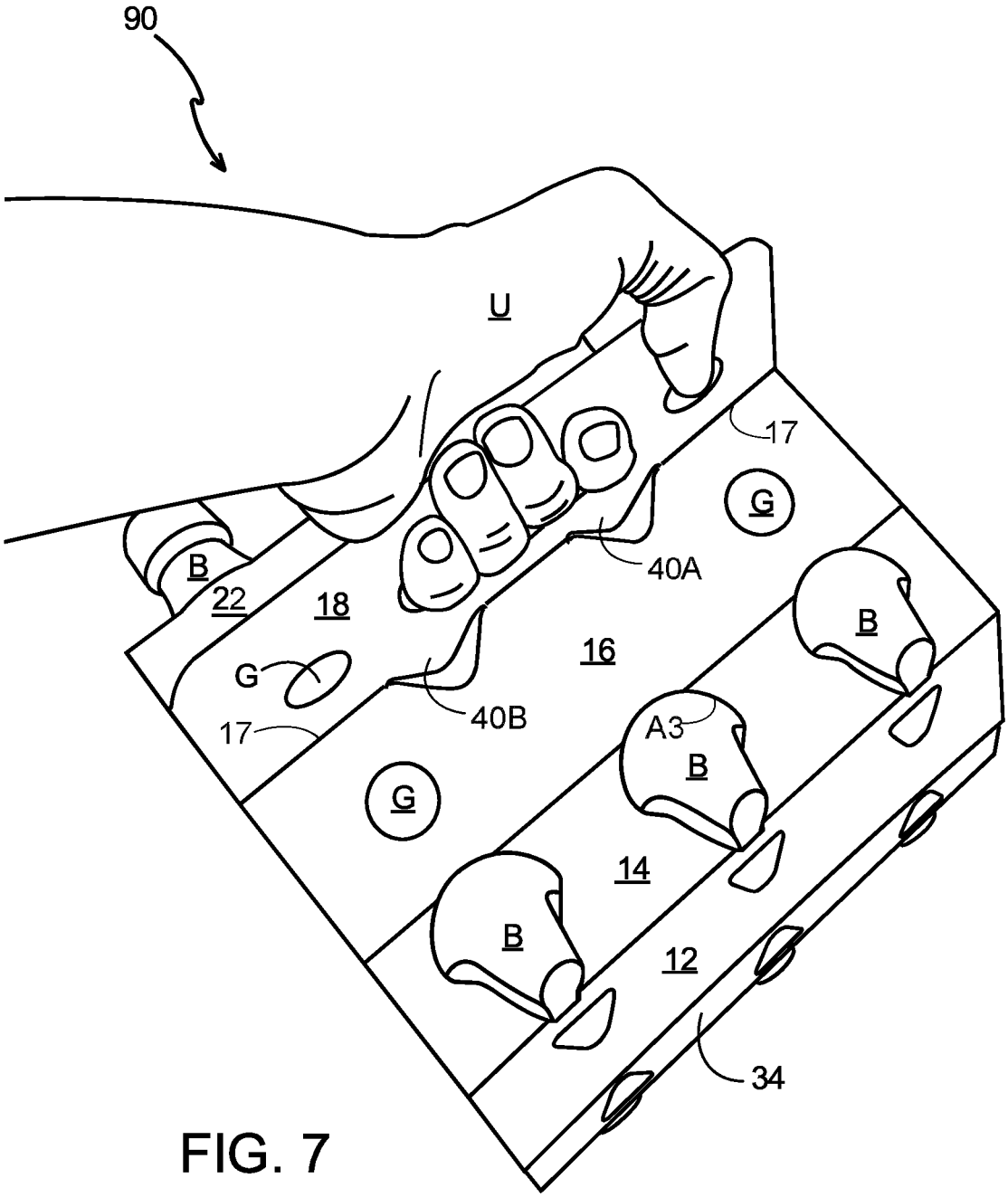

FIG. 3 illustrates the carton 90 in which the carrying handle is secured in a stowed condition. A user can break the bond between first handle panel 18 and the first first side panel portion 16 and unfold the carrying handle to a deployed or operable condition, as shown in FIGS. 5, 6 and 7, such that it extends outwardly from the tubular structure of the carton 90. The tabs 40A, 40B, 42A, 42*b* extend inwardly and are disposed internally of the tubular structure of the carton 90. FIGS. 5, 6, 7 each illustrates the carrying handle 18/20 in use (or in a position of use) wherein the handle panels 18, 20 are upstanding from the first side wall 16/22. When the handle 18/20 is in the position of use, the tabs 40A, 40B, 42A, 42B each extends into the interior of the carton 90 and is disposed between the respective generally cylindrical bodies of a pair of adjacent bottles B to serve as a spacer and or a stabilizer.

The carrying handle can be employed to withdraw or remove the carton 90 from a shelf or other display apparatus at a point of sale, as shown in FIG. 5. Once removed the carton 90 can be carried by the user U with the first and second panels 18, 20 in a substantially upright orientation as shown in FIGS. 6 and 7. In FIG. 5, the articles B are arranged such that a cylindrical axis of the articles B is substantially vertical or upright and the top panel 26 is substantially horizontal and forms top wall of the carton 90. In FIGS. 6 and 7, the articles B are arranged such that a cylindrical axis of the articles B is substantially horizontal and the top panel 26 is substantially vertical or upright and forms a side wall of the carton 90.

The present disclosure provides a carton 90 for packaging articles B. The carton 90 comprises a plurality of panels forming walls of a tubular structure including a top wall 26, a first side wall 16/22, a base wall 12/34, and a second side wall 30. The carton 90 comprises a carrying handle having at least one handle panel 18, 20 hingedly connected to one of the plurality of panels. The carrying handle may be hingedly connected to the first side wall 16/22. The carrying handle may comprise first and second handle panels 18, 20 hingedly connected to each other at a distal end thereof and hingedly connected to a respective one of an upper and a lower first side wall panel portion 16, 22 at proximal ends thereof. The hinged connections at the proximal ends may be interrupted by one or more cut lines each defining a tab 40A, 40B, 42A, 42B. The tab 40A, 40B, 42A, 42B may be struck from one of the upper and lower first side wall panel portions 16, 22, that is to say the tabs 40A, 40B, 42A, 42B may be formed from material which would otherwise form the upper and lower first side wall panel portions 16, 22. The tabs 40A, 40B, 42A, 42B may be integral with the first and second handle panels 18, 20 and extend from the proximal hinged connection 17/21 internally of the carton 90 when in use. The first and second handle panels 18, 20 each comprise a handle opening; the handle openings H are spaced a first distance d1 from the proximal hinged connections 17, 21. The handle openings H are spaced a maximum distance equal to the sum of the first distance d1 and a second distance d2 from proximal ends of the respective first and second handle panels 18, 20. The tab 40A, 40B, 42A, 42B comprises a maximum linear dimension equal to the second distance d2. The second distance d2 is measured from the proximal hinged connection 17, 21 to the furthest point of the tabs 40A, 40B, 42A, 42B.

The present disclosure also provides a carton 90 comprising a plurality of panels forming walls of a tubular structure including a top wall 26, a first side wall 16/22, a base wall 12/34, and a second side wall 30. The carton 90 comprises a carrying handle comprising at least one handle panel 18, 20 hingedly connected to one of the plurality of panels. The carrying handle may be hingedly connected to one of the first side wall 16/22 or the second side wall. The carrying handle may comprise at least one handle panel 18, 20 hingedly connected at a proximal end to said one of the first side wall 16/22 or the second side wall 30 by at least one fold line 17, 21. The at least one fold line and/or a hinged proximal end of the at least one handle panel 18, 20 is disposed in a spaced apart relationship from each of the top wall 26 and base wall 12/34. The at least one fold line and/or the hinged proximal end of the at least one handle panel 18, 20 is oriented substantially parallel to the top wall 26 and to the base wall 12/34. The at least one fold line and/or the hinged proximal end of the at least one handle panel 18, 20 is oriented substantially parallel to the hinged connection, fold line 25, between said one of the first side wall 16/22 or second side wall 30 and the top wall 26. The at least one fold line and/or the hinged proximal end of the at least one handle panel 18, 20 is oriented substantially parallel to the hinged connection, fold line 13, between said one of the first side wall 16/22 or second side wall 30 and the base wall 12/34. Optionally, said one of the first side wall 16/22 or second side wall comprises an upper corner or shoulder panel 24, 26. Optionally, said one of the first side wall 16/22 or second side wall comprises a lower corner or heel panel 14, 32. The at least one handle panel 18, 20 may be detachably secured in face contacting relationship to said one of the first side wall 16/22 or second side wall 30.

The present disclosure also provides a carton 90 comprising a plurality of panels forming walls of a tubular structure including a top wall 26, a first side wall 16/22, a first heel panel 14, a base wall 12/34, a second heel panel 32 and a second side wall 30. The carton 90 comprises opening A3 forming an article engaging device. The opening A3 is struck at least in part from one of the first and second heel panels 14, 32. The opening A3 comprises an upper portion and a lower portion, the lower portion is narrower in width than the upper portion. The lower portion defines opposing free edges of said one of the first and second heel panels 14, 32. The free edges are configured to form a close fit with a lobe of a petaloid base of an article B. The opposing free edges inhibit movement of the article B when the petaloid lobe of the article B is received in the opening A3. The opening A3 may be struck in part from the base wall 12/34. The opening A3 may be struck in part from the one of the first and second side walls 16/22, 30. The lower portion may define tapered opposing free edges of said one of the first and second heel panels 14, 32 which converge towards the base wall 12/34.

It can be appreciated that various changes may be made within the scope of the present invention. For example, the size and shape of the panels and apertures may be adjusted to accommodate articles of differing size or shape.

It will be recognised that as used herein, directional references such as "top", "bottom", "base", "front", "back", "end", "side", "inner", "outer", "upper" and "lower" do not necessarily limit the respective panels to such orientation, but may merely serve to distinguish these panels from one another.

As used herein, the terms "hinged connection" and "fold line" refer to all manner of lines that define hinge features of the blank, facilitate folding portions of the blank with respect to one another, or otherwise indicate optimal panel folding locations for the blank. Any reference to "hinged connection" should not be construed as necessarily referring to a single fold line only; indeed, a hinged connection can be formed from two or more fold lines wherein each of the two or more fold lines may be either straight/linear or curved/curvilinear in shape. When linear fold lines form a hinged connection, they may be disposed parallel with each other or be slightly angled with respect to each other. When curvilinear fold lines form a hinged connection, they may intersect each other to define a shaped panel within the area surrounded by the curvilinear fold lines. A typical example of such a hinged connection may comprise a pair of arched or arcuate fold lines intersecting at two points such that they define an elliptical panel therebetween. A hinged connection may be formed from one or more linear fold lines and one or more curvilinear fold lines. A typical example of such a hinged connection may comprise a combination of a linear fold line and an arched or arcuate fold line which intersect at two points such that they define a half moon-shaped panel therebetween.

As used herein, the term "fold line" may refer to one of the following: a scored line, an embossed line, a debossed line, a line of perforations, a line of short slits, a line of half-cuts, a single half-cut, an interrupted cutline, a line of aligned slits, a line of scores and any combination of the aforesaid options.

It should be understood that hinged connections and fold lines can each include elements that are formed in the substrate of the blank including perforations, a line of perforations, a line of short slits, a line of half-cuts, a single half-cut, a cutline, an interrupted cutline, slits, scores, any combination thereof, and the like. The elements can be dimensioned and arranged to provide the desired functionality. For example, a line of perforations can be dimensioned or designed with degrees of weakness to define a fold line and/or a severance line. The line of perforations can be designed to facilitate folding and resist breaking, to facilitate folding and facilitate breaking with more effort, or to facilitate breaking with little effort.

The phrase "in registry with" as used herein refers to the alignment of two or more elements in an erected carton, such as an aperture formed in a first of two overlapping panels and a second aperture formed in a second of two overlapping panels. Those elements in registry with each other may be aligned with each other in the direction of the thickness of the overlapping panels. For example, when an aperture in a first panel is "in registry with" a second aperture in a second panel that is placed in an overlapping arrangement with the first panel, an edge of the aperture may extend along at least a portion of an edge of the second aperture and may be aligned, in the direction of the thickness of the first and second panels, with the second aperture.

The invention claimed is:

1. A carton comprising a plurality of panels forming walls of a tubular structure including a top wall, a first side wall, a base wall, and a second side wall, the base wall comprising a pair of first and second overlapping base panels, the carton comprises a carrying handle having at least one handle panel hingedly connected to one of the first and second side walls, the carrying handle comprising at least one handle panel hingedly connected at a proximal end thereof to said one of the first and second side walls by at least one fold line, wherein the at least one fold line is disposed in a spaced apart relationship from each of the top wall and the base wall, the at least one fold line is oriented substantially parallel to the top wall and to the base wall.

2. A carton according to claim 1 wherein the at least one fold line is oriented substantially parallel to the hinged connection between said one of the first and second side walls and the first base panel.

3. A carton according to claim 1 wherein the at least one handle panel is detachably secured in face contacting relationship to said one of the first side wall or second side wall.

4. A carton according to claim 1 wherein the at least one handle panel is folded into in face contacting relationship to said one of the first side wall or second side wall.

5. A carton according to claim 1 wherein the at least one handle panel is adhesively secured by a bond in face contacting relationship to said one of the first and second side walls, said bond being severable such that the at least one handle panel is foldable outwardly of the tubular structure.

6. A carton comprising a plurality of panels forming walls of a tubular structure including a base wall, a first side wall, and a first heel panel hingedly connected therebetween, the carton comprising an opening forming an article engaging device, wherein the opening is struck at least in part from the first heel panel, the opening comprises an upper portion and a lower portion, the lower portion is narrower in width than the upper portion, the lower portion is defined by opposing free edges provided by the first heel panel.

7. A carton according to claim 6 wherein the opening is struck in part from the base wall.

8. A carton according to claim 6 wherein the opening is struck in part from the first side wall.

9. A carton according to claim 6 wherein the opposing free edges are tapered such that the opposing free edges converge towards the base wall.

10. A carton according to claim 6 wherein the lower portion of the opening extends into the base wall and defines a free edge which engages a base of the article.

11. A carton according to claim 6 wherein the carton comprises a top panel having an article receiving aperture for receiving an upper end of the article.

12. A carton according to claim 6 wherein the free edges are configured to form a close fit with a lobe of a petaloid base of an article being packaged by the carton.

13. A blank for forming a carton, the blank comprising a plurality of panels for forming walls of a tubular structure including; a top wall, a first side wall, a pair of first and second overlapping base panels, and a second side wall, the blank comprising a carrying handle having at least one handle panel hingedly connected to one of the first and second side walls, the carrying handle comprising at least one handle panel hingedly connected at a proximal end to said one of the first and second side walls by at least one fold line, wherein the at least one fold line is disposed in a spaced apart relationship from each of the top wall, the first base panel and the second overlapping base panel, the at least one fold line is oriented substantially parallel to the first and second base panels when the blank is formed into the tubular structure.

14. A blank according to claim 13 wherein the at least one fold line is interrupted by at least one cut line defining a tab, the tab being struck from one of the first and second side walls, wherein the tab is integral with the at least one handle panel and extends from the hinged connection internally of the carton when in use.

15. A blank according to claim 14 wherein the tab extends from the at least one fold line toward the other of the first and second side walls when the blank is formed into the tubular structure.

16. A blank according to claim 14 wherein the tab is struck from one of upper and lower portions of the one of the first and second side walls.

17. A blank according to claim 13 wherein the at least one handle panel comprises first and second handle panels secured together in a flat face contacting arrangement, the first handle panel being hingedly connected to an upper portion of the first side wall along a first fold line, the second handle panel being hingedly connected at a proximal end thereof to a lower portion of the first side wall along a second fold line.

18. A blank carton according to claim 13 wherein the carrying handle comprises first and second handle panels hingedly connected to each other at a distal end thereof and hingedly connected to a respective one of an upper and a lower first side wall panel portion at proximal ends thereof.

* * * * *